US006422646B1

(12) United States Patent
McNally

(10) Patent No.: US 6,422,646 B1
(45) Date of Patent: Jul. 23, 2002

(54) KEYBOARD SUPPORT

(76) Inventor: Michael Francis McNally, 576 Englehardt St., Albury, New South Wales 2640 (AU)

( * ) Notice: Subject to any disclaimer, the term of this patent is extended or adjusted under 35 U.S.C. 154(b) by 0 days.

(21) Appl. No.: 09/403,946

(22) PCT Filed: Apr. 29, 1999

(86) PCT No.: PCT/AU99/00318

§ 371 (c)(1),
(2), (4) Date: Oct. 29, 1999

(87) PCT Pub. No.: WO00/65961

PCT Pub. Date: Nov. 9, 2000

(51) Int. Cl.[7] ..... A47B 39/00; A47B 83/02

(52) U.S. Cl. ..... 297/170; 297/161; 297/173; 297/149

(58) Field of Search ..... 297/170, 172, 297/171, 173, 161, 149, 160

(56) References Cited

U.S. PATENT DOCUMENTS 5,169,210 A * 12/1992 Fricano
5,573,301 A * 11/1996 Scott ..... 297/173
5,601,331 A * 2/1997 Austin, Jr. et al. ..... 297/170
5,653,499 A * 8/1997 Goodall
5,765,911 A * 6/1998 Sorenson ..... 297/173 X
5,816,648 A * 10/1998 Baccili et al.
5,893,607 A * 4/1999 Trimnell

FOREIGN PATENT DOCUMENTS

WO WO 87/05478 * 9/1987

* cited by examiner

*Primary Examiner*—Anthony D. Barfield
(74) *Attorney, Agent, or Firm*—Greer, Burns & Crain, Ltd.

(57) ABSTRACT

A support adapted to cooperate with a pedestal type chair for holding a keyboard at an optimal operating position for a user seated in said chair, said support including a clamp adapted for retrofittable attachment to the stem of a pedestal chair, a first transversely extending arm extending laterally from said clamp and passing through a first elbow to a first generally vertical extending post, a second vertical extending post pivotally fitted to said first vertical extending post and passing through a second elbow to a second transversely extending arm and a platform adapted for slidable and pivotal attachment to said second transversely extending arm.

10 Claims, 4 Drawing Sheets

KEYBOARD SUPPORT

INTRODUCTION TO INVENTION

Figure 1:
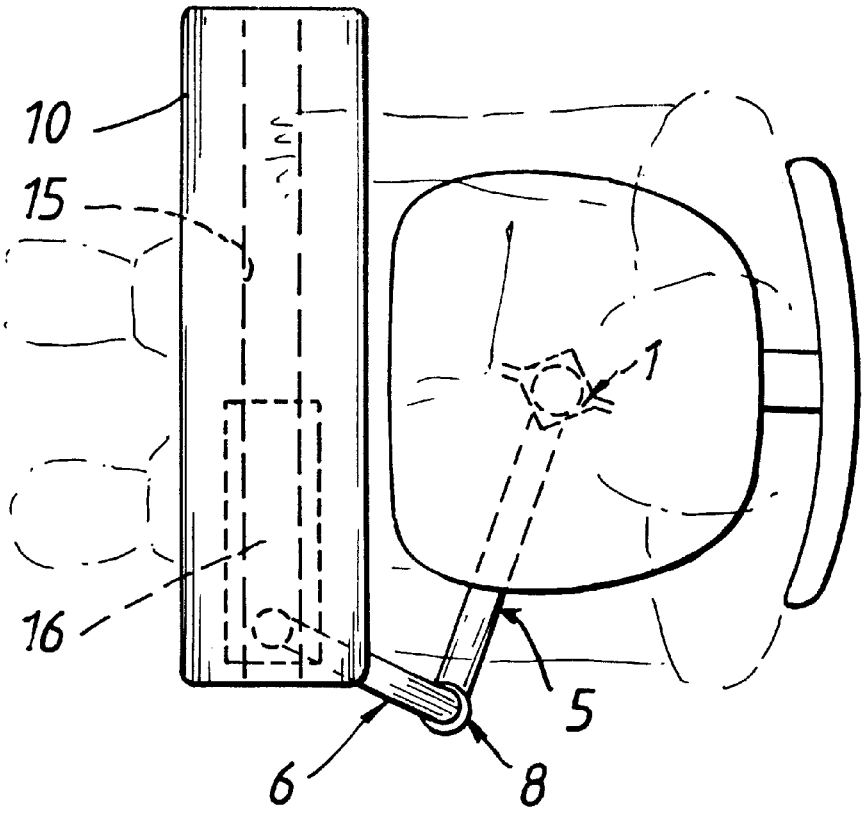

This invention relates to the ergonomic positioning of computer keyboards and in particular to an improved support adapted for retrofitting or incorporation with a standard office chair so as to allow a computer keyboard to be readily positioned relative to said chair in order to optimise the ergonomic relationship between the occupant of a chair and a computer keyboard used by the occupant.

BACKGROUND TO INVENTION

The ever increasing use of computers and associated keyboards and/or the "mouse" in many aspects of the workplace has exposed the physical damage such use can cause personnel particularly where long term or continuous keyboard mouse use is a requirement of their occupation.

Whilst the use of a keyboard/mouse per se does not appear to cause immediate problems, the tendency of users to adopt poor physical posture while using keyboards appears to be a key contributing factor to injuries encountered by computer users.

In particular, the placement of a computer keyboard appears to play a major role in adopting poor posture as the seated user—most users are seated—tend to lean forward to reach a keyboard rather than drawing their chair right up to the keyboard. Except in cases where an operator has a dedicated keyboard shelf located at or near knee height in their desk, most operators locate computer monitors, keyboard or laptops on desk tops and it is not always practical to have such a keyboard immediately and close at hand and therefore invariably such operators reach away to touch a keyboard and in so doing place unnecessary strain on their backs, shoulders and necks which manifest in the all too common injuries as previously discussed.

In order to overcome such problems, modem "computer desks" may incorporate a "lap height" drawer for housing a keyboard. Such a drawer can be extended at any time in order to place the keyboard within the operators reach close to the operator at about arm height. Further developments include chair brackets and mounting systems as disclosed in U.S. Pat. Nos. 5,169,210 and 5,653,499. Such mounting systems are adapted to hold computer keyboards at an ergonomically correct position, or to be readily adjustable to provide same. Whilst the above mentioned devices overcome many of the ergonomic problems detailed, these prior art devices are not readily adapted for retrofitting to existing pedestal chairs and/or are bulky and difficult to adjust for each individual user.

OBJECT AND STATEMENT OF INVENTION

One object of the invention is to provide an improved keyboard and/or mouse support.

In one aspect the invention provides a support adapted to cooperate with a pedestal chair for holding a keyboard at an optimal operating position for a user seated in said chair, said support including a clamp adapted for retrofittable attachment to the stem of a pedestal chair, a first transversely extending arm extending laterally from said clamp and passing through a first elbow to a generally vertical extending post, a second transversely extending arm pivotally fitted to said vertical extending post and passing through a second elbow to a horizontal extending arm; and a platform adapted for slidable and pivotal attachment to said horizontal extending arm so as to provide a horizontal platform adapted for vertical movement and horizontal articulated movement relative to said chair to allow said platform to be readily positioned over the lap region of an occupant of said chair and readily moveable away from said lap region in a plurality of possible horizontal motions.

The clamp may include an open mouth region to allow for ready fitting and removal from the stem of a chair without the need to disassemble the chair. The clamp may also include a substantial surface area for contact with the stem to ensure rigid attachment to the chair. The clamp may comprise a foot fitted to the first transversely extending arm and a mating clamp plate. The clamp may be fitted by thumb screws either side of the foot or a single thumb screw and a hinged clamp or by an overcenter quick action lever.

The vertical extending post and second transversely extending arm may be of circular cross-section as may be the first transversely extending arm and the horizontal extending arm.

The pivotal fitting of the vertical extending post to the second transversely extending arm may be by way of a telescopic fitting of the above with the second transversely extending arm fitting co-axially into the vertical extending post.

The relative movement of the pivot joint may be controlled by a co-axially fitted collar adapted to clamp the above joint so as to fix the joining of the vertical extending post to the second transversely extending arm at the required vertical and horizontal position.

The platform may be provided with an elongate tee-slot on the underside adapted to receive a key which in turn is adapted for fitting to the horizontal extending arm. The key may be freely moveable along the length of the tee-slot and provided with a thumb wheel tightening nut to allow the platform to be secured at the most desirable lateral position.

The invention will be described in greater detail with reference to the following figures.

FIG. 1—shows a plan view of the support in left hand use.

Figure 2:
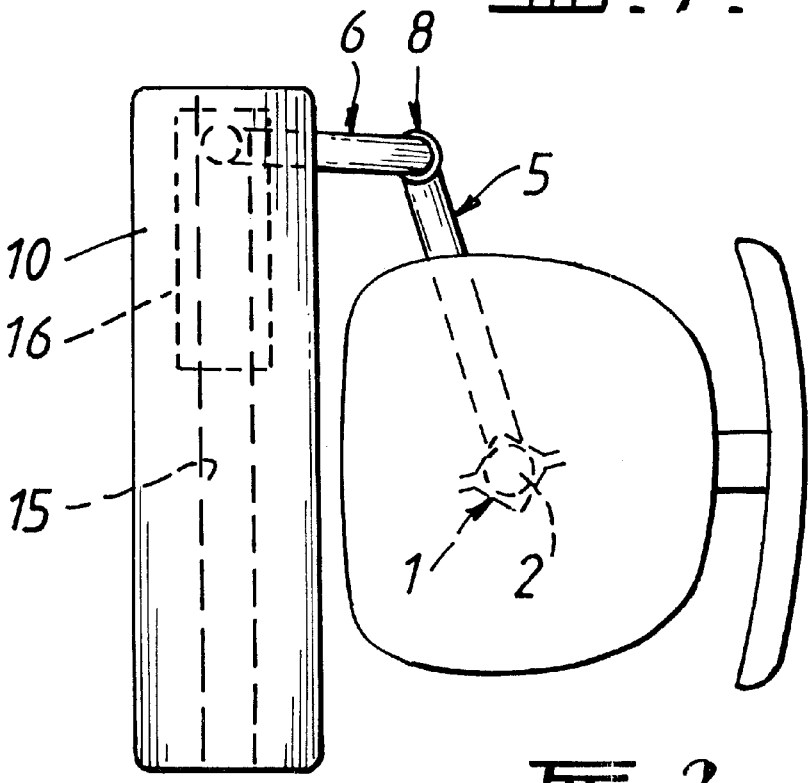

FIG. 2—shows a plan view of the support in right hand use.

Figure 3:
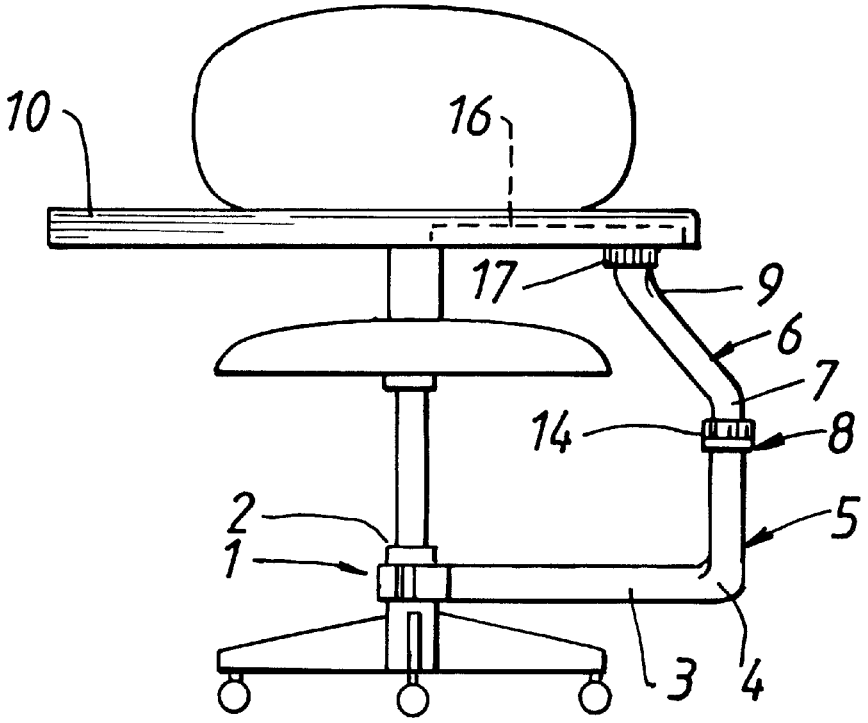

FIG. 3—shows a front view of the support fitted to a chair.

Figure 4:
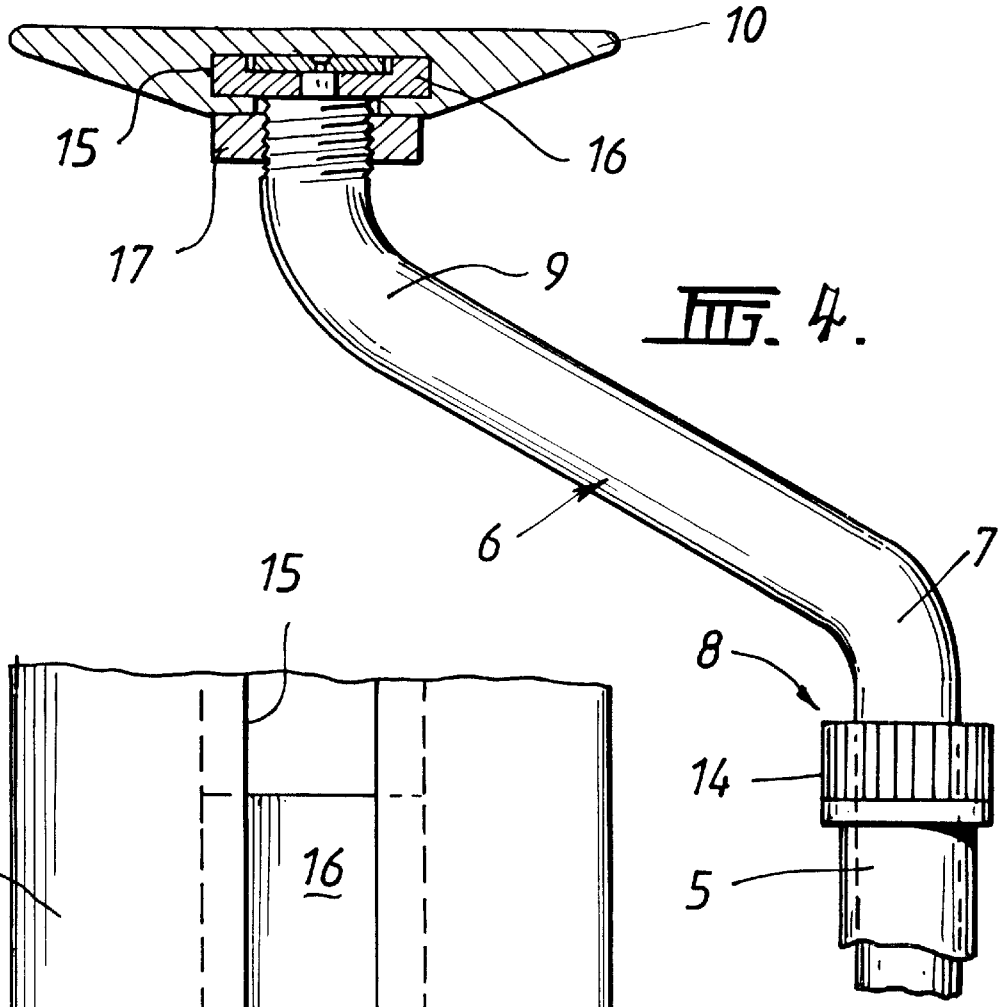

FIG. 4—shows detail of the horizontal extending arm fitted to the platform.

Figure 5:
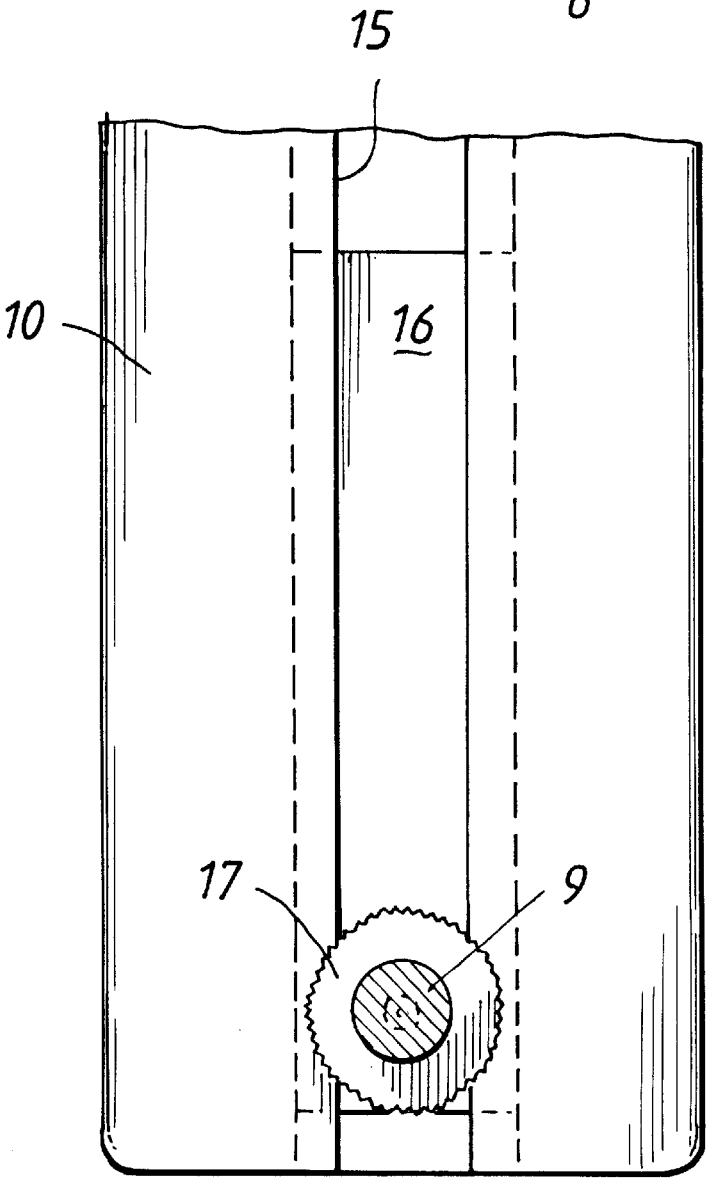

FIG. 5—shows the underside of the platform.

Figure 6:
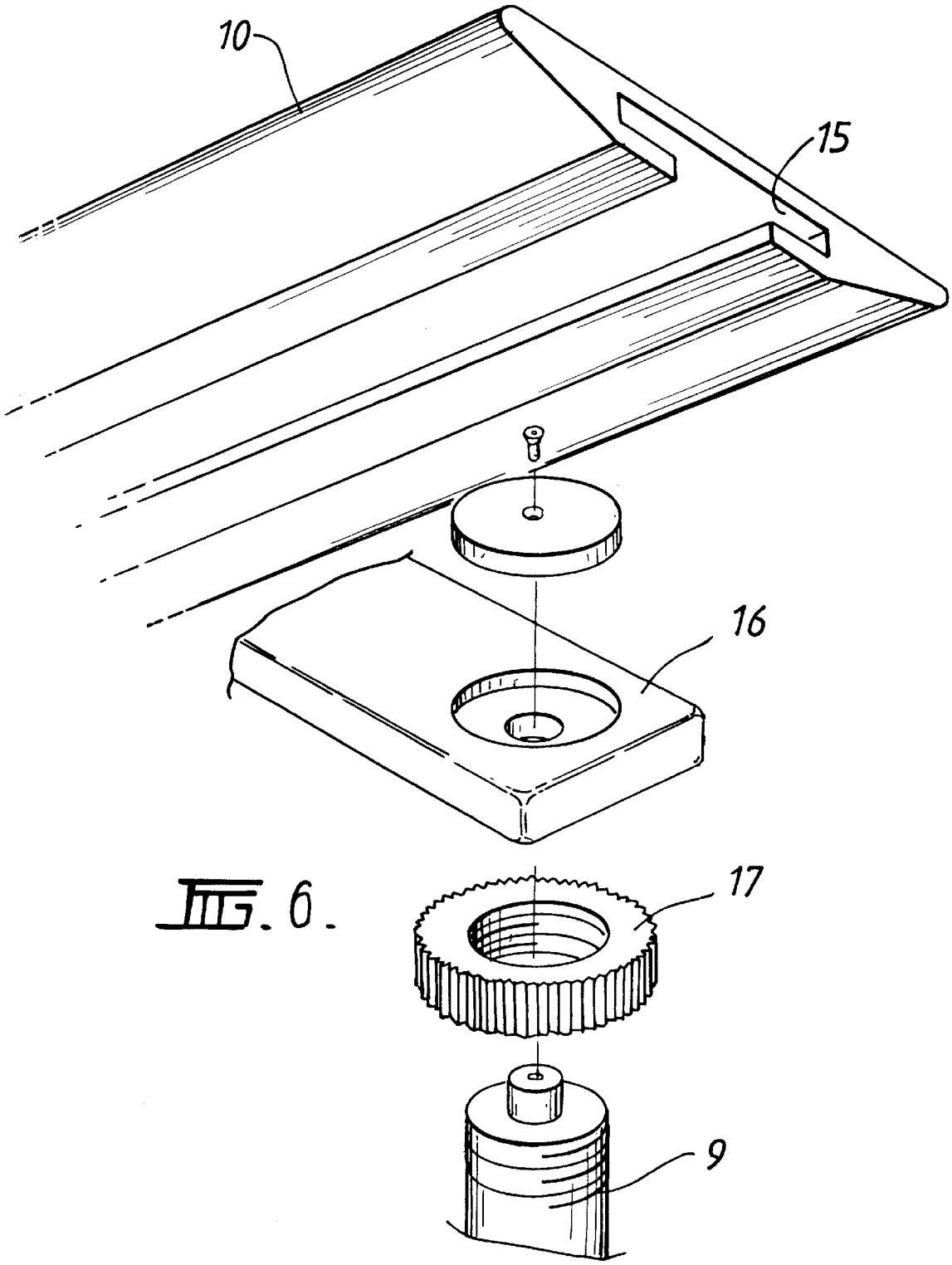

FIG. 6—shows the underside of the platform fitting in exploded form.

Figure 7:
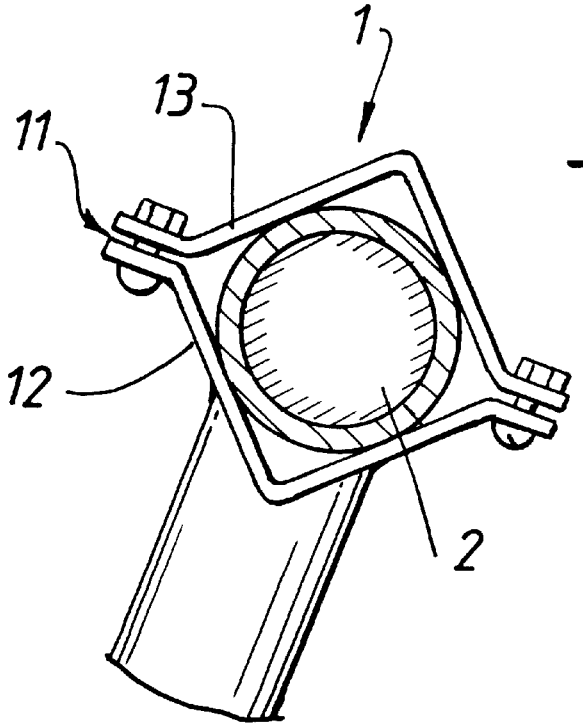

FIG. 7—shows a plan view in cross section of the clamp.

The invention will now be described in more detail by reference to the aforesaid figures, although those figures only detail one particularly preferred embodiment of the invention and the scope of the current patent application is not to be limited to those particularly preferred embodiments.

Referring firstly to FIG. 3, the support is shown as fitted to an armless office chair (although the support will equally fit chairs with side arms). The support includes a clamp means 1 adapted for ready fitting to and removal from the stem 2 of a standard pedestal office chair. The clamp 1 forms the means of fitting the support to the chair and the clamp is directly attached to a first transversely extending arm 3 which is formed in a general horizontal position and of a dimension to allow the support to extend out beyond the general dimensions of the seat region of the chair to which the support is fitted. The clamp can be fitted for either right or left hand fixing of the support with the support rising to either the right or left side of the user.

The first transversely extending arm passes through a first elbow 4 to a first generally vertical extending post 5. The first vertical extending post terminates in a pivot means 8 in the form of a co-axial collar 14. The co-axial collar 14 provides for the telescopic insertion of a second vertical extending post 6 which co-axially slides in a snug fit into the first vertical extending post 5 and can be provided with vertical movement in and out of the first vertical extending post or simultaneously provided with pivotal movement around the first vertical extending post.

The second vertical extending post passes through a second elbow 7 to a second transversely extending arm 9. The second transversely extending arm 9 allows the support to be moved back to the region occupied by the lap of the user and a platform 10 is slidably and pivotally attached to the said second transversely extending arm in a manner that allows the platform to be moved laterally and pivotally so as to provide a full range of articulated movements in a horizontal plane and vertical movements which allows the platform complete flexibility in relation to the placement of a keyboard on said platform relative to the lap region of an occupant of the chair. The range of movement can be seen by reference to FIGS. 1 and 2.

Referring to FIG. 7, the clamp may include an open mouth region 11 at or near the foot of the clamp 12 which provides for the ready placement of the support as a retrofit to the stem 2 of an existing chair. The clamp may be provided with a clamp plate 13 which is of a suitable configuration and dimension along with the foot 12 to allow the clamp to securely and rigidly fit the first transversely extending arm to the stem of the chair. In alternative embodiments, the clamp can be fitted by way of thumb screws or a hinged arrangement using just one thumb screw or alternatively, any manner of well known quick release levers can be incorporated to affect the clamping operation. Referring now to FIG. 3, the first and second vertical extending posts 5 and 6 can be circular in cross section along with the other major structural components of the support including the first and second transversely extending arms and with the provision of such a tube construction, the vertical extending posts can be readily engaged in a telescopic co-axial engagement to allow full pivotal movement relative to each other along with vertical movement simultaneously or independently. The support is provided with a co-axial collar 14 which is screwed onto the first vertical extending post and forms a locking means to arrest the relative movement of the two vertical extending posts when a suitable configuration has been reached.

The platform section 10 of the support is provided with an elongate tee-slot 15 positioned centrally underneath the platform and running the substantial length of the platform. The tee-slot can be dimensioned to receive an elongate key 16 fitted to the second transverse extending arm 9 and suitable fasteners 17 can be used so as to allow the platform to be locked at any point along the length of the tee-slot.

Referring now to FIGS. 4 and 5, the particular detail regarding the fitting of the platform 10 to the second transverse extending arm 9 is shown in exploded form with the platform having an elongate tee-slot 15 running on the underside along the length of the platform for receiving a key 16. The key is held and locked in place along the tee-slot by the provision of a pivotal fitting to the second transversely extending arm 9 which is held in place and lockable by means of a large thumb screw 17 or any other suitable fastener.

In use, the support can be made up of a small number of component parts which are readily transportable and packaged and is particularly adapted for retrofitting to existing pedestal office chairs. The support would be rapidly assembled and fitted by way of the clamp to the stem of an existing office chair and once the operator was positioned on the chair, the fall range of vertical and horizontal articulated movements of the platform could be adjusted and positioned so as to provide a platform positioned just above the user's lap and therefore providing ready access for a computer keyboard/mouse or other keyboard device for use in the optimal ergonomic position for the user without any distraction or use of the user's desk space. Furthermore, the invention allows the user to place the mouse on either the left or right hand side depending on the user's hand dominance. When use of the keyboard is no longer required, the platform could be readily rotated or moved around in a large number of ways by virtue of the articulated linkages which allow ready exit from the chair by the user. Alternatively, where a chair has a fixed stem with a rotating seat, all the user has to do is to pivot around away from the support. The support is dimensioned to fit most keyboards and can be readily extended if required.

The invention provides for the first time an economical, reliable robust and highly versatile mount particularly adapted for retrofitting to existing office chairs so as to provide a highly versatile accessory for use in offices reliant on the use of keyboards or computer systems.

I claim:

1. A support for fitting to a pedestal type chair of the kind having a plurality of legs radiating outwardly from a lower portion of an upright stem and a seating portion supported by said upright stem, said support adapted for holding a keyboard at an optimal operating position for a user seated in said chair, said support comprising a stem clamp for attachment to said upright stem of said chair, a first member, a second member, and a platform for supporting said keyboard or a computer mouse, said first member having a first portion extending from said stem clamp in a generally transverse direction, a second portion being a generally vertically extending post portion and an elbow interconnecting said first and second portions, said second member having a vertically extending first portion and a second portion extending transversely to said vertically extending first portion and an elbow interconnecting said first and second portion of said second member, said generally vertically extending post portion of said first member and said vertically extending first portion of said second member being telescopically fitted together such that said second member is adjustable vertically and pivotally relative to said first member, said platform being slidably and pivotally connected to an upper part of said second member, said platform being pivotally connected to an upper part of said second member such that said platform pivots about a substantially vertical axis.

2. A support according to claim 1 wherein said stem clamp includes an open mouth region.

3. A support according to claim 2 wherein said stem clamp includes a foot fitted to an end of said first portion of said first member and a mating clamp plate for securing around said stem of said chair.

4. A support according to claim 3 wherein said mating clamp plate is hinged to one side of said foot and tightened around said stem by a screw or a quick action lever.

5. A support according to claim 1 wherein said vertically extending post portion of said first member and said second vertically extending first portion of said second member are circular in cross section and are connected to each other in a co-axial manner.

6. A support according to claim 5 further comprising a collar for screw clamping said generally vertically extending post portion of said first member and said vertically extending first portion of said second member.

7. A support according to claim 1, wherein said platform has an elongate underside tee-slot for slidably engaging a key pivotally fitted to an upper part of the second portion of said second member.

8. A support according to claim 7 further comprising fastening means for locking said key in said tee-slot.

9. A support according to claim 7 wherein said key is pivotally fitted to said second member such that said key can pivot about said second member around only a vertical axis.

10. A support for fitting to a pedestal type chair of the kind having a plurality of legs radiating outwardly from a lower portion of an upright stem and a seating portion supported by said upright stem, said support adapted for holding a keyboard at an optimal operating position for a user seated in said chair, said support comprising a stern clamp for attachment to said upright stem of said chair, a first member, a second member, and a platform for supporting said keyboard or a computer mouse, said first member having a first portion extending from said stem clamp in a generally transverse direction, a second portion being a generally vertically extending post portion and an elbow interconnecting said first and second portions, said second member having a vertically extending first portion and a second portion extending upwardly relative to said vertically extending first portion and inwardly relative to said chair and an elbows interconnecting said first and second portion of said second member, said generally vertically extending post portion of said first member and said vertically extending first portion of said second member being telescopically fitted together such that said second member is adjustable vertically and pivotally relative to said first member, and vertically extending post portion of said first member and said vertically extending first portion of said second member being circular in cross section and being connected to each other in a coaxial member, a collar for screw clamping said generally vertically extending post portion of said first member and said vertically extending first portion of said second member, said platform including an elongate underside tee-slot for slidably engaging a key pivotally fitted to an upper part of said second portion of said second member such that said platform is slidably connected to an upper part of said second member and said platform is pivotally connected to an upper part of said second member such that said platform pivots about a substantially vertical axis, and fastening means for locking said key in said tee-slot.

* * * * *